US005150691A

United States Patent [19]

Imajo

[11] Patent Number: 5,150,691

[45] Date of Patent: Sep. 29, 1992

[54] ENGINE FUEL INJECTOR

[75] Inventor: Minoru Imajo, Kanagawa, Japan

[73] Assignee: Nissan Motor Co., Ltd., Japan

[21] Appl. No.: 824,624

[22] Filed: Jan. 23, 1992

[30] Foreign Application Priority Data

Jan. 25, 1991 [JP] Japan ..... 3-7803

[51] Int. Cl.[5] ..... F02M 69/46

[52] U.S. Cl. ..... 123/531; 123/472; 123/432; 123/308; 239/533.3

[58] Field of Search ..... 123/308, 432, 472, 531; 239/533.2, 533.3, 533.12, 565

[56] References Cited

U.S. PATENT DOCUMENTS

| | | | |
|---|---|---|---|
| 4,325,341 | 4/1982 | Yamauchi et al. | 239/533.2 |
| 4,361,126 | 11/1982 | Knapp et al. | 123/472 |
| 4,373,491 | 2/1983 | Knapp | 123/472 |
| 4,556,037 | 12/1985 | Wisdom | 123/472 |
| 4,708,117 | 11/1987 | Mesenich et al. | 123/531 |
| 4,798,190 | 1/1989 | Vaznaian et al. | 123/531 |
| 4,945,877 | 8/1990 | Ziegler et al. | 123/472 |
| 5,027,778 | 7/1991 | Nogi et al. | 123/531 |

FOREIGN PATENT DOCUMENTS

| | | |
|---|---|---|
| 60-97373 | 12/1983 | Japan . |
| 63-106357 | 10/1986 | Japan . |
| 63-132876 | 2/1987 | Japan . |
| 64-11364 | 7/1987 | Japan . |
| 1-118159 | 2/1988 | Japan . |

*Primary Examiner*—E. Rollins Cross
*Assistant Examiner*—Erick Solis
*Attorney, Agent, or Firm*—Lowe, Price, LeBlanc & Becker

[57] ABSTRACT

This invention concerns a fuel injector for an engine having a combustion chamber provided with a plurality of intake ports, an intake manifold connected to these ports via a branch, intake valves which open and close the ports, and stems passing through the ports which support the intake valves. A fuel injector body is provided upstream of the branch, and the fuel delivered by this body is ejected near the valve stems of the intake ports via a guide pipe which is branched at its end. The openings in the ends of the guide pipe are preferably situated on the side of the center of the combustion chamber, and inject fuel only when the intake valves are open. A mixing mechanism may also be provided to mix fuel and air in the body of the fuel injector. The ends of the guide pipe may also be further branched toward respectively the center and the outside of the combustion chamber. By means of this construction, fuel is prevented from depositing on the walls of the intake ports or the stems of the intake valves, is converted efficiently to fine droplets, and is dispersed evenly in the combustion chamber.

6 Claims, 7 Drawing Sheets

ENGINE FUEL INJECTOR

FIELD OF THE INVENTION

This invention relates to an engine provided with a plurality of intake ports and a single fuel injector for each cylinder, and more particularly, an improvement of a fuel injector intended to make the fuel density in the engine combustion chamber uniform.

BACKGROUND OF THE INVENTION

In engines provided with a plurality of intake ports for one combustion chamber, the intake ports may for example be branched in the cylinder head, a fuel injector may be provided immediately before the branch, and fuel sprayed toward the branch.

With this kind of system, however, much of the fuel sprayed collides with the walls of the intake ports, and tends to set up a liquid wall flow along the walls. As this wall flow reaches the combustion chamber later than the vaporized fuel, the air-fuel ratio (AFR) is rendered unstable and engine running performance declines.

To improve this situation, Jikkai Sho 60-97373 and Jikkai Sho 63-132876 published by the Japanese Patent Office disclose a fuel injector having a fuel injection outlet pointing towards each intake port.

In this case, fuel is sprayed toward every port, and wall flow is therefore less. However, even in this fuel injector, there is a small distance from the outlet situated just before the branch and the intake valve, and it is therefore impossible to avoid some of the fuel being deposited on the wall of the port or on the stem of the intake valve which opens and closes the port before it reaches the chamber.

In another method of preventing wall flow, Tokkai Sho 63-106357, Jikkai Hei 1-118159 and Jikkai Shoe 64-11364 published by the Japanese Patent Office disclose a structure wherein fuel and air are mixed in the injector to promote conversion of fuel to fine droplets and mixing.

In this system, fuel is injected from a valve in the injector, and the mixture of this fuel with air aspirated into the fuel injector is delivered by a guide pipe close to the intake valve where is it expelled.

In this fuel injector, wall flow in the intake port is completely prevented. However, the guide pipe from the fuel injector body leads close to the intake valve, and in an engine provided with a plurality of intake ports for each cylinder as described hereintofore, fuel can be supplied to only one port. It was therefore difficult to overcome the problem of unevenness of fuel density in the combustion chamber.

SUMMARY OF THE INVENTION

It is therefore an object of the invention to make the fuel density in the combustion chamber uniform as well as to prevent wall flow in an engine provided with a plurality of intake ports for one cylinder.

In order to achieve the above object, this invention provides a fuel injector for an engine provided with a cylinder head, a combustion chamber situated below the cylinder head, a plurality of intake ports in the cylinder head facing the combustion chamber, a branch where these intake ports divide, an intake manifold connected to the intake ports via the branch, intake valves which open and close the intake ports, and steams passing through the intake ports which support the intake valves on the cylinder head. This fuel injector comprises a fuel injector body situated between the branch and the intake manifold, and a guide pipe having branched ends for ejecting fuel delivered from the fuel injector body near the steam of each intake valve.

According to a preferred aspect of this invention, the ends of the guide pipe is situated closer to the center of the combustion chamber than the intake valve stem.

According to another preferred aspect of this invention, the fuel injector body is provided with a mixing mechanism that mixes fuel and air before fuel injection.

According yet another preferred aspect of this invention, the fuel injector body injects fuel only when the intake valves are open.

According to yet another preferred aspect of this invention, each end of the guide pipe are further divided into two branches opening onto either side of the intake valve steam adjacent respectively to the center and the outer side of the combustion chamber.

In this case, the branch opening onto a side of the intake valve steam adjacent to the outer side of the combustion chamber has a smaller cross-section than the branch opening onto a side of the intake valve stem adjacent to the center side of the combustion chamber.

DESCRIPTION OF THE PREFERRED EMBODIMENTS

Figure 1:
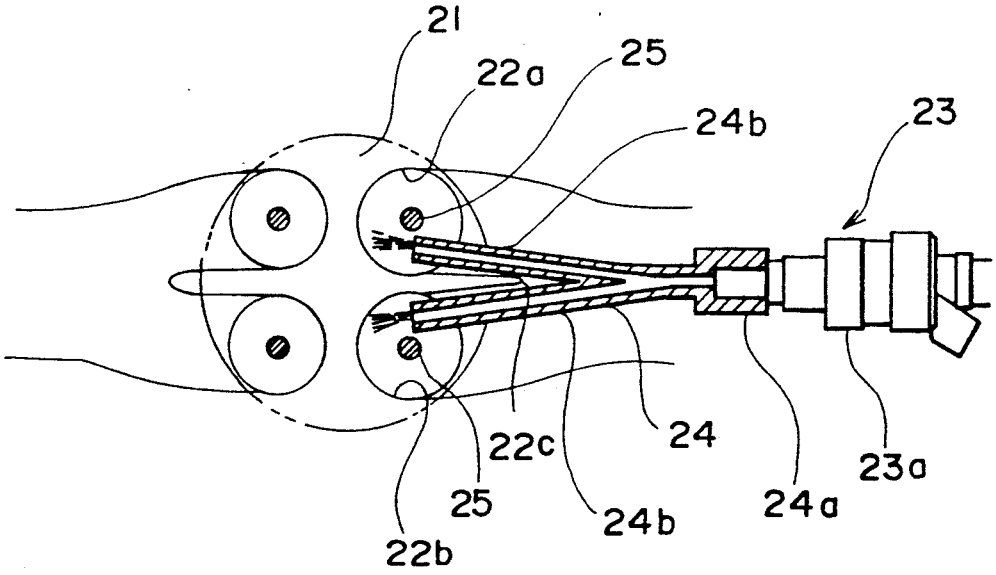
FIG. 1 is a plan view of an engine cylinder head showing the location of a fuel injector according to this invention.
Figure 2:
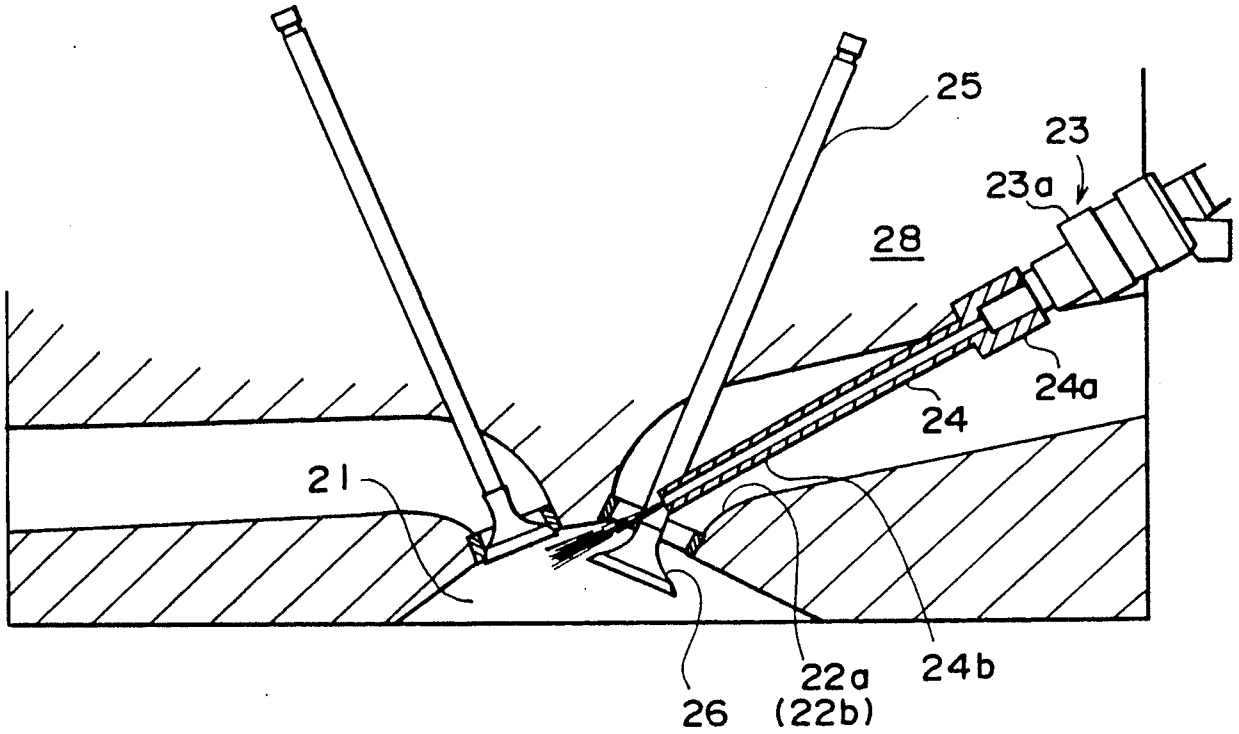
FIG. 2 is a vertical section of an engine cylinder head also showing the location of the fuel injector according to this invention.

FIG. 1 shows the structure of a cylinder head 28 of an engine. Two intake ports 22*a*, 22*b* are formed facing each combustion chamber 21 of this cylinder head 28. These intake ports 22*a*, 22*b* are fashioned like Siamese ports branched in the cylinder head 28, and intake valves 26 are provided in an opening of each of the intake ports 22*a*, 22*b*. The intake valves 26 are lifted by stems 25 passing through each of the intake ports 22*a*, 22*b*, and air is aspirated into the combustion chamber 21 from an intake manifold depending on the lift.

A single fuel injector 23 is also provided upstream of a branch 22*c* of the intake ports 22*a*, 22*b* in order to supply fuel to the combustion chamber 21. The fuel injector comprises a body 23*a* and a guide pipe 24. The guide pipe 24 is connected to the body 23 via a connector 24*a*.

A fuel injection valve, not shown, is installed in the body 23*a*. This valve is opened and closed by a electromagnetic coil in response to a pulse signal so as to supply fuel intermittently to the guide pipe 24 via the connector 24*a*.

As shown in FIG. 1, the guide pipe 24 is branched in a "Y" shape midway along its length in the same way as the intake ports 22*a*, 22*b*. The ends 24*b* of the branch project into the intake ports 22*a*, 22*b*, are directed at a point near the center of the combustion chamber 21, and open onto one side of the stem 25 of the intake valve 26 closer to the center of the chamber 21 than the stem 25.

The guide pipe 24 and the body 23*a* of the fuel injector 23 ave a separate construction. The guide pipe 24 is previously fixed in the engine cylinder head 28 by casting or another method. Further, the guide pipe 24 and the body 23*a* are formed in one piece construction via the connector 24*a*.

Figure 3:
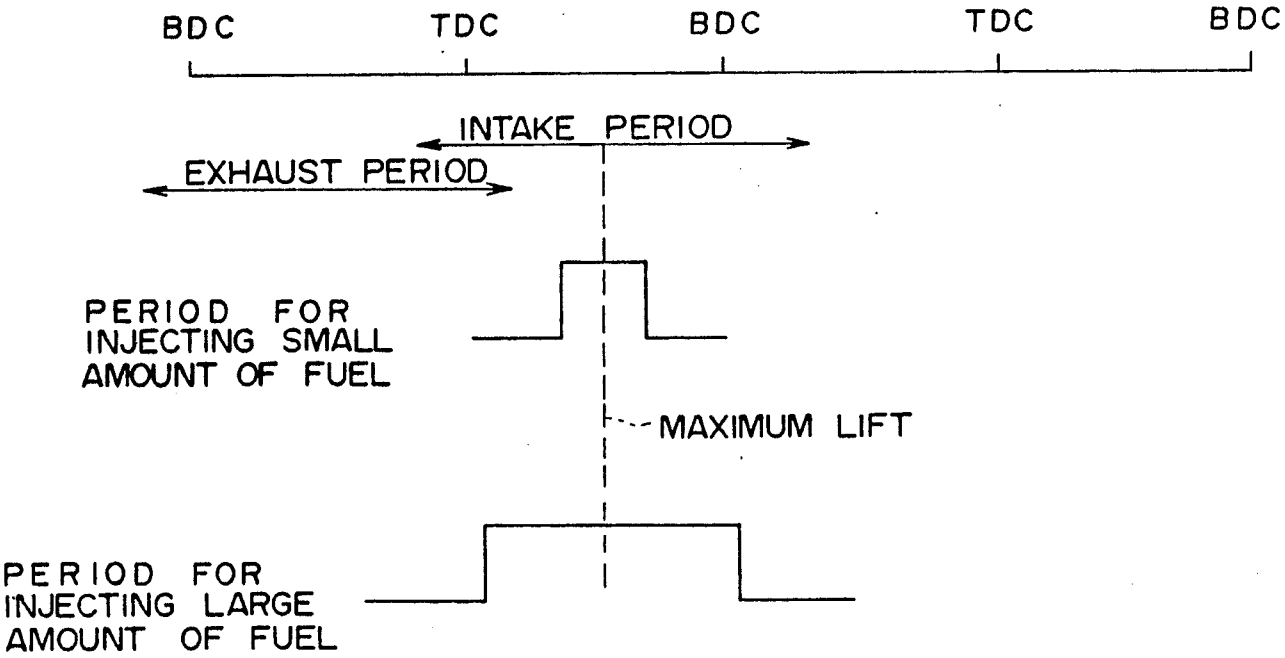
FIG. 3 is a fuel injection timing chart according to this invention.

The fuel injector 23 injects fuel from the tips of the ends 24*b* of the guide pipe 24 according to a pulse signal. This injection is performed, as shown in FIG. 3, within a predetermined range depending on the fuel injection amount having the maximum lift position of the intake valve 26 as its center.

Fuel is therefore injected directly into the combustion chamber 21 without colliding with the stem 25 or the walls of the intake ports 22*a*, 22*b*. Further, the injection position is closer to the center of the combustion chamber 21 than the stem 25 some distance away from the opposite wall of the chamber 21, and there is therefore no risk of fuel colliding with the opposite wall of the combustion chamber 21 to set up a wall flow. Fuel injected into the chamber 21 is therefore dispersed uniformly.

Figure 4:
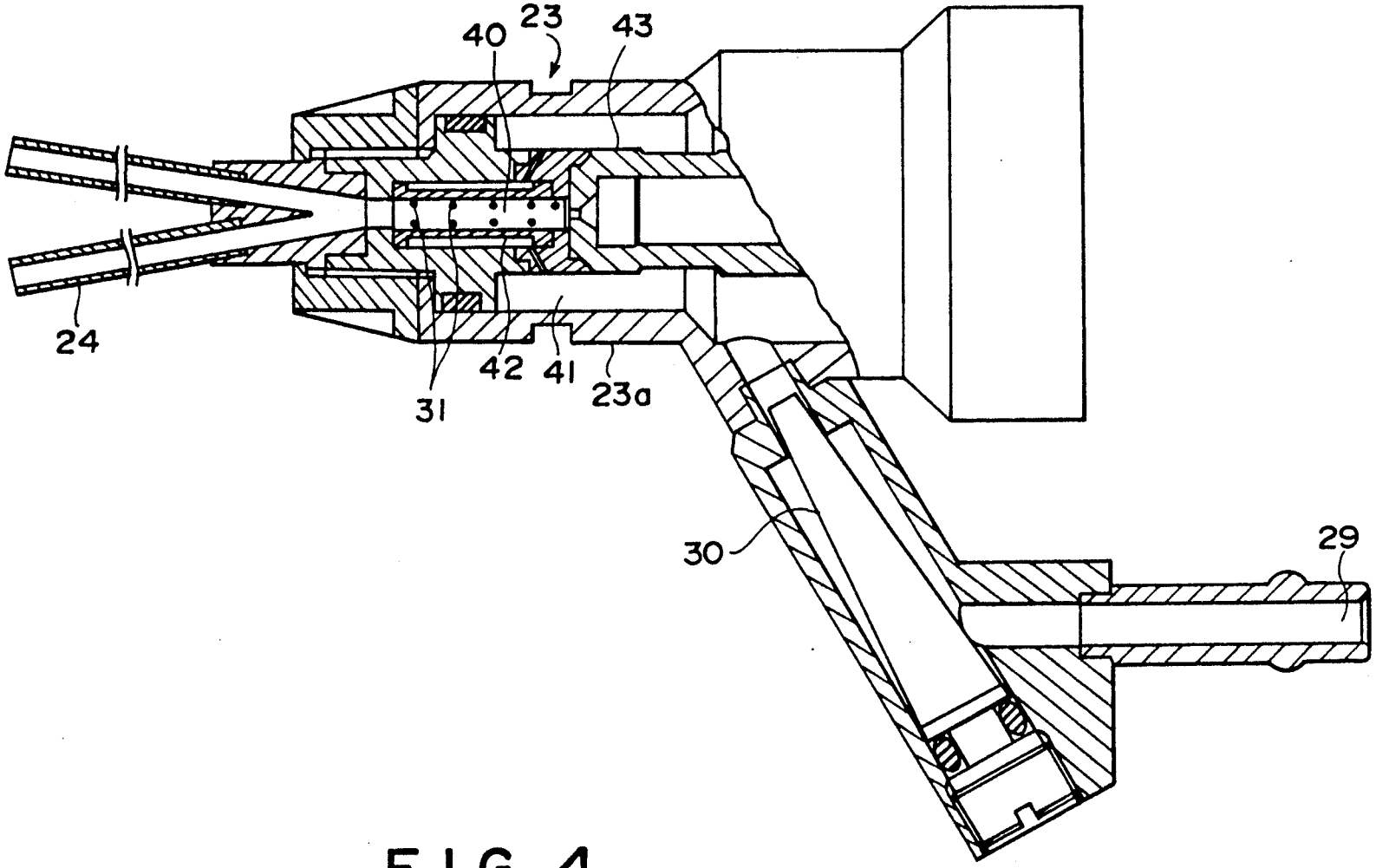
FIG. 4 is a plan view of the fuel injector according to this invention.

In addition to the aforesaid construction, an enhanced effect may be obtained by providing the fuel injector 23 with an "assist air" mixing mechanism as shown in FIG. 4.

In this figure, the fuel injector 23 is provided with an air inlet port 29. Air led in from this inlet port 29 reaches an internal chamber 41 of the body 23*a* of the fuel injector 23 via a valve 30 for adjusting flowrate, and is ejected from a circular passage 42 into a fuel passage 40 via a plurality of ejection ports 31.

Fuel is supplied from a fuel injection valve 43 situated at the base of this fuel passage 40, and a connector 24*a* of the guide pipe 24 is connected to the end of the fuel passage 40. Fuel supplied from the fuel passage 40 is therefore mixed with air ejected from the ports 31, and is ejected as a mixture into the combustion chamber 21 from the guide pipe 24. By first mixing fuel and air together in the fuel injector 23 in this way, conversion of fuel to fine droplets is promoted.

Figure 5:
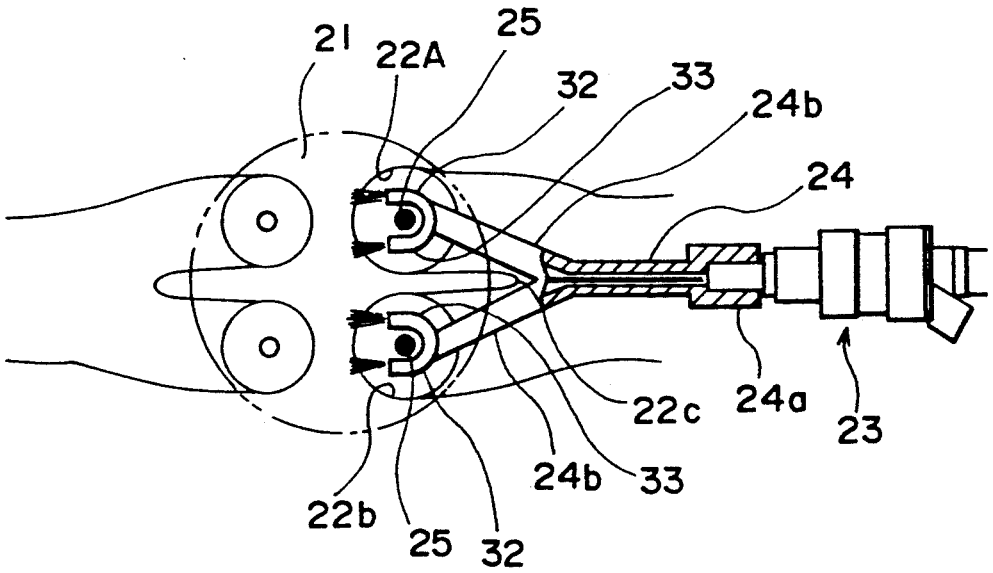
FIG. 5 is a drawing similar to FIG. 1 but showing another embodiment of this invention regarding the shape and position of a guide pipe.
Figure 6:
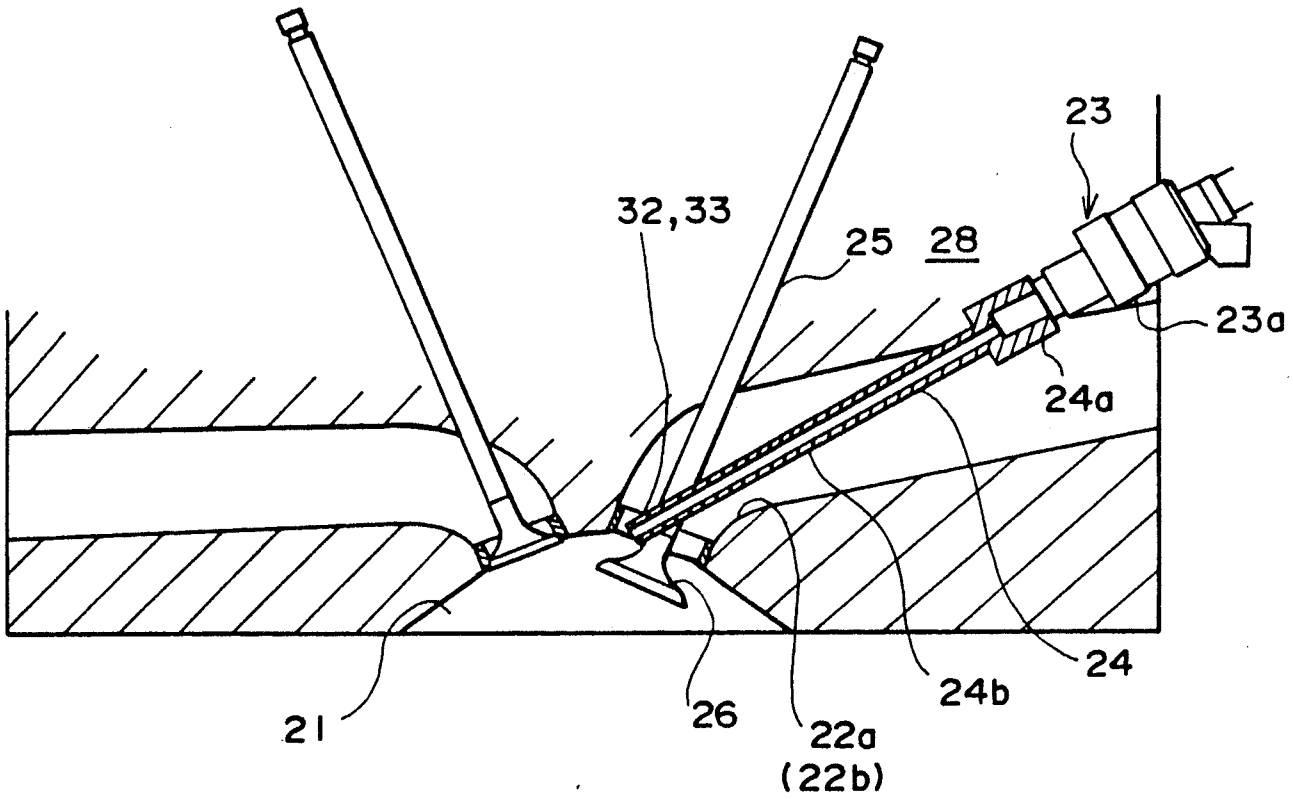
FIG. 6 is a drawing similar to FIG. 2 but showing the embodiment of FIG. 5.

If the ends 24*b* of the guide pipe 24 are also branched in a "U" shape so as to open onto either side of the stems 25 as shown in FIGS. 5 and 6, deposition of fuel on the stems 25 can be effectively prevented, and homogenizing of fuel injected into the chamber 21 is further enhanced. In this case, the cross-section of the branches 32 opening onto the outer side of the stems 25 is made smaller than that of the branches 33 opening onto the inner side of the stems 25. More fuel is thereby distributed to the branches 33 so that the fuel density in the center of the combustion chamber 21 does not thin out.

Figure 7:
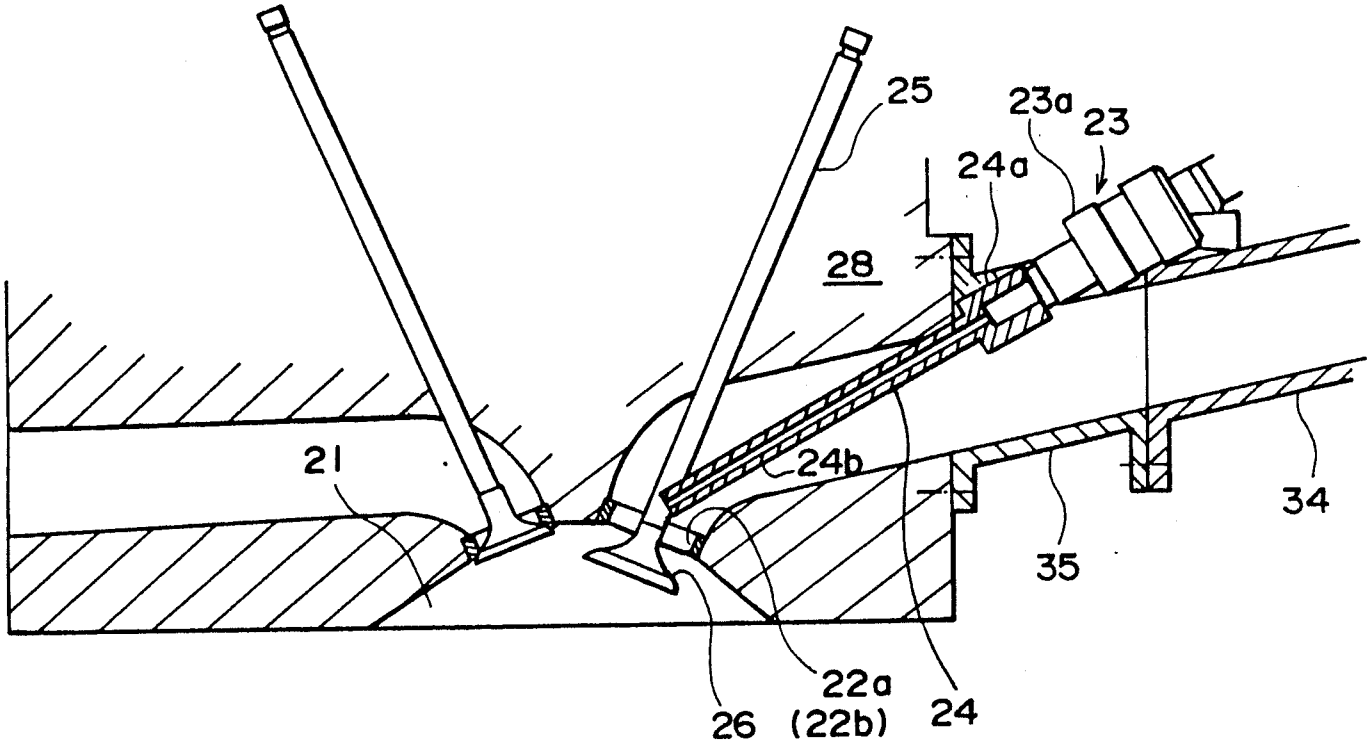
FIG. 7 is a vertical section of the cylinder head showing yet another embodiment of this invention regarding the support structure of the fuel injector.

FIG. 7 shows another embodiment regarding the installation of the fuel injector 23. In this figure, the fuel injector 23 is not fixed directly in the cylinder head 28 or intake manifold 34, but is previously fixed on an adapter 35 forming part of the intake manifold 34 and interposed between the cylinder head 28 and the manifold 34.

More specifically when the adapter 35 is cast, the guide pipe is first fixed by casting or internal chill, the adapter 35 is then interposed between the cylinder head 28 and the intake manifold 34, and the fuel injector 23 is then attached.

In this construction, the guide pipe 24 is easily attached to the engine, and the precision of installing the fuel injector 23 on the guide pipe 24 is improved.

This invention is not limited to the above description, and various modifications may be made by those skilled in the art within the scope of the claims which are appended. Possible modifications include, for example, application to an engine provided with three or more intake ports for one combustion chamber.

The embodiments of this invention in which an exclusive property or privilege is claimed are defined as follows:

1. A fuel injector adapted to be installed in an engine provided with a cylinder head, a combustion chamber situated below the cylinder head, a plurality of intake ports in the cylinder head facing the combustion chamber, a branch where these intake ports divide, an intake manifold connected to the intake ports via the branch, intake valves which open and close the intake ports, and stems passing through the intake ports which support the intake valves on the cylinder head, said fuel injector comprising:

a fuel injector body situated between the branch and the intake manifold, and a guide pipe having branched ends for ejecting fuel delivered from said fuel injector body near the stem of each intake valve.

2. A fuel injector adapted to be installed in an engine as defined in claim 1, wherein the ends of said guide pipe are situated between the intake valve stems when viewed from directly above the combustion chamber.

3. A fuel injector adapted to be installed in an engine as defined in claim 1, wherein said fuel injector body further comprises a mixing mechanisms for mixing fuel and air before fuel injection.

4. A fuel injector adapted to be installed in an engine as defined in claim 1, wherein said fuel injector body injects fuel only when the intake valves are open.

5. A fuel injector adapted to be installed in an engine as defined in claim 1, wherein the ends of said guide pipe are further divided into two branches opening onto either side of the intake valve stem adjacent respectively to the center and the outer side of the combustion chamber when viewed from directly above the combustion chamber.

6. A fuel injector adapted to be installed in an engine as defined in claim 5, wherein the branch opening onto a side of the intake valve steam adjacent to the outer side of the combustion chamber has a smaller cross-section that the branch opening onto a side of the intake valve stem adjacent to the center side of the combustion chamber.

* * * * *